United States Patent [19]

Baumgartner

[11] Patent Number: 4,755,278

[45] Date of Patent: Jul. 5, 1988

[54] PROCESS FOR FRACTIONATING SOLID ASPHALTS

[75] Inventor: Pierre Baumgartner, Grenoble, France

[73] Assignee: Institut Francais du Petrole, Rueil Malmaison, France

[21] Appl. No.: 19,262

[22] Filed: Feb. 26, 1987

[30] Foreign Application Priority Data

Feb. 26, 1986 [FR] France ..... 86 02782

[51] Int. Cl.[4] ..... C10C 1/18

[52] U.S. Cl. ..... 208/45; 208/309; 208/311; 208/313; 208/321; 208/428; 208/322; 208/323; 208/370; 106/273 R; 106/278; 44/51; 44/61; 241/14; 241/15; 241/16

[58] Field of Search ..... 208/45, 309, 428, 311, 208/313, 321, 322, 323, 370, 435, 22, 39; 106/273 R, 278; 44/51, 61

[56] References Cited

U.S. PATENT DOCUMENTS

| | | | |
|---|---|---|---|
| 2,440,311 | 4/1948 | Tiddy | 208/45 |
| 3,079,326 | 2/1963 | Neuworth | 208/45 |
| 3,206,388 | 9/1965 | Pitchford | 208/45 |
| 3,360,455 | 12/1967 | Corbett et al. | 208/45 |
| 3,434,967 | 3/1969 | Oldengurg | 208/309 |
| 3,684,699 | 8/1972 | Vermeulenetal | 208/45 |
| 3,733,259 | 5/1973 | Wilson et al. | 208/309 |
| 3,761,387 | 9/1973 | Wegener | 208/45 |
| 3,776,052 | 10/1973 | Brodovsky et al. | 208/45 |
| 3,779,895 | 12/1973 | Wilson et al. | 208/309 |
| 3,884,829 | 5/1975 | Moyer | 208/45 |
| 3,904,428 | 9/1975 | McConnaughay | 106/273 |
| 3,923,537 | 12/1975 | Wood | 106/278 |
| 4,021,335 | 5/1977 | Beaton | 208/309 |
| 4,108,681 | 8/1978 | Lawson et al. | 208/45 |
| 4,133,740 | 1/1979 | Paraskos et al. | 208/45 |
| 4,139,451 | 2/1979 | Pavilcius et al. | 208/45 |
| 4,269,693 | 5/1981 | Hastie | 208/45 |
| 4,279,739 | 7/1981 | Roach | 208/309 |
| 4,537,600 | 8/1985 | Taijima et al. | 44/61 |
| 4,572,781 | 2/1986 | Krasuk et al. | 208/309 |
| 4,582,591 | 4/1986 | Hoermeyer et al. | 208/309 |
| 4,623,359 | 11/1986 | Yaghmare et al. | 208/428 |
| 4,634,520 | 1/1987 | Angelov et al. | 208/309 |
| 4,686,028 | 8/1987 | Van Driesen et al. | 208/45 |

FOREIGN PATENT DOCUMENTS

| | | | |
|---|---|---|---|
| 2550545 | 2/1985 | France | 208/309 |
| 0010324 | 1/1974 | Japan | 106/278 |
| 1340022 | 12/1973 | United Kingdom | 208/309 |
| 1384290 | 2/1975 | United Kingdom | 208/309 |

OTHER PUBLICATIONS

*The Condensed Chemical Dictionary*, Sixth Edition, Reinhold Publishing Corp., pp. 1099, 438, and 439.

*Primary Examiner*—Helen M. S. Sneed
*Assistant Examiner*—Helane Myers
*Attorney, Agent, or Firm*—Millen & White

[57] ABSTRACT

This process for fractionating solid asphalts is operable under low temperature and pressure conditions.

The process consists of treating a suspension of asphalt powder in a surfactant-containing aqueous phase by means of a hydrocarbon solvent immiscible with water and of separating:

an hydrocarbon phase containing asphalt of softening point lower than that of the initial asphalt, and an aqueous phase wherein is suspended asphalt of softening point higher than that of the initial asphalt.

16 Claims, 1 Drawing Sheet

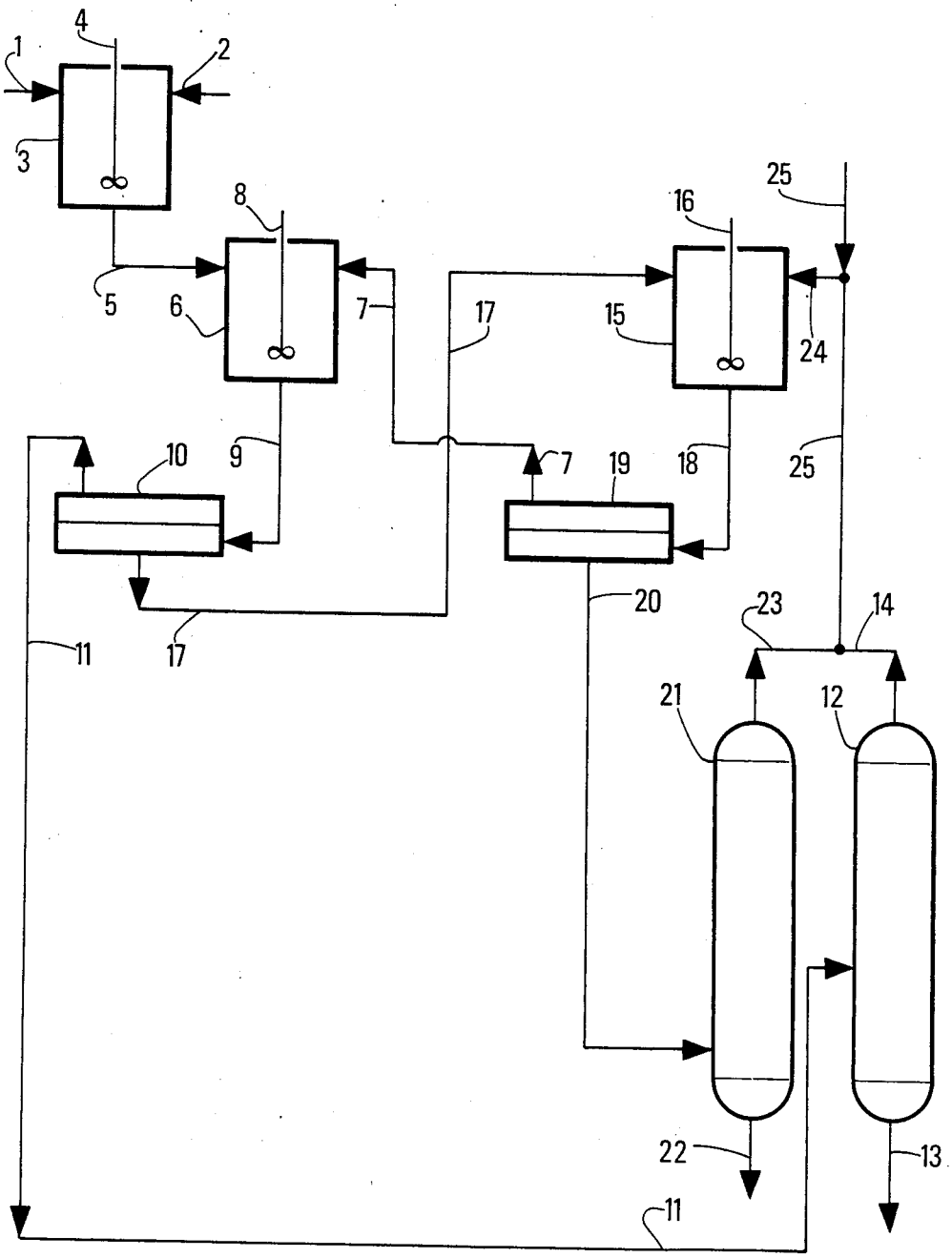
1
2
3
4
5
6
7
8
9
10
11
12
13
14
15
16
17
18
19
20
21
22
23
24
25

PROCESS FOR FRACTIONATING SOLID ASPHALTS

The invention concerns a process for fractionating solid asphalts, operable under low temperature and pressure conditions.

BACKGROUND OF THE INVENTION

Current refinery feedstocks more and more frequently include such products as straight-run or vacuum residues of conventional oils, crude or topped oils or even shale or bituminous sand oils.

These various feedstocks are characterized by a very high asphaltene and "resin" content. These products, which also contain other heteroatoms such as sulfur and nitrogen, with metal complexes of vanadium or nickel, make very difficult the conventional refining of such feedstocks.

In catalytic processes, hydrotreatment performance quickly decreases as a result of nickel and vanadium sulfide deposits on the catalysts, which poison them. In catalytic cracking using zeolite cataysts, the high Conradson carbon content of said feedstocks results in coke deposits requiring an increased temperature for catalyst regeneration. Moreover, the overly high nickel and vanadium contents of the feedstocks have some negative effects (substantial gas formation, modification of the catalysts resulting in a loss of their activity). In hydrocracking, the feedstock must not contain more than a very small proportion of asphaltenes in order to avoid quick poisoning of the catalyst active sites.

In the visbreaking thermal process, the severity of the operation conditions depends on the asphaltene content of the feedstock. The coagulation of the partially cracked asphaltene molecules results in instability of effluents, which tend to settle during storage and to clog filters.

All these disadvantages have induced the refiners to separate asphaltene and resin compounds from oily fraction containing them. This separation is achieved by the so-called solvent deasphalting technique which consists of breaking the prevailing balance between the asphaltenes and the maltenic medium by adding to the feedstock a solvent which decreases the interfacial tension and the viscosity of the medium.

For this purpose, light paraffins or olefins containing 3 to 7 carbon atoms are mostly used, either alone or as an mixtures. These products act as antisolvent for asphaltenes, and for any resins any.

For a given feedstock, the yield to deasphalted oil and its quality depend on the type of solvent, on the volume ratio of the solvent to the feedstock and on the temperature and pressure of the deasphalting operation.

The composition and the characteristics of the phase which precipitates during the deasphalting operation, called the "asphalt phase", may thus vary within a very wide range. This asphalt phase may be roughly divided into two categories of compounds, one, called "asphaltenes", defined as all the products which precipitate by means of excess n-heptane, according to Standard AFNOR T60-115, the other, called "resins", defined as all the products insoluble in propane but soluble in heptane. It is well-known that asphaltenes contain the major part present in the metals (nickel and vanadium) of heavy oils.

On the other hand, in an economical deasphalting process, the asphalt fraction must be as low as possible for a given quality of deasphalted oil. It is known that, everything else being unchanged, the yield of asphalt decreases with an increasing molecular weight of the deasphalting solvent. Presently, a solvent such as the so-called $C_5$ cut, essentially consisting of pentane and isopentane, is more and more frequently used. For a given feedstock, the use of propane instead of pentane results in an increased yield of deasphalted oil, since the latter will contain a part of the "resins". A good compromise can nevertheless be obtained between quality and quantity of the obtained deasphalted oil.

With respect to the asphalt phase, the tendency to use deasphalting solvents of higher molecular weight results in a decrease of the yield by weight, corresponding to a lower resin content. As far as quality is concerned, the asphalts precipitated according to said method generally have softening points (measured according to the BaLL and Ring method, Standard AFNOR T 66-008 higher than 100°-120° C., and which may be as high as 180° C.-200° C.

Such asphalts are difficult to use. Their softening point is too high for economical use as a bitumen covering for roads. Their combustion as fluxed fuels, without special adaptation of the conventional combustion units, produces an amount of unburnt particles incompatible with the legal requirements; moreover, their relatively high softening point requires dilution with a substantial amount of fluxing agent.

As solid fuel, their softening point, mostly of about 120°-160° C., is too low for an easy use in units of the fluid bed type. Thus, the division of said phase into two fractions, one of which has a softening temperature lower than that of the initial asphalt, associated with a lower metal content, and the other a very high softening temperature, e.g. higher than 250° C., is economically advantageous.

By the process according to the present invention, solid asphalts, as particles suspended in an aqueous medium, are divided into two fractions by addition of a solvent immiscible with water, so as to obtain a first asphalt fraction in the solvent and a second asphalt fraction suspended into the aqueous medium, having such a viscosity that said suspension can be easily conveyed and pumped.

Many documents of the prior art disclose the fractionation of heavy oils into three fractions: asphaltenes, "resins" and deasphalted oil, by the action of at least one deasphalting solvent, these separations being performed in several successive steps.

This technique is disclosed, for example, in U.S. Pat. No. 2,940,920, where a single deasphalting solvent is used; briefly stated, it consists of subjecting the feedstock, in a first step, to the action of a light paraffinic or olefinic solvent in excess, under such conditions as to separate in said step, by settling, a lower asphalt phase and an upper oily phase. In a second step, the oily phase obtained in the first step is brought to higher temperature and pressure, producing the separation between the lower phase formed of resins and an upper phase comprising the deasphalting solvent and the residual oil. These two constituents are separated in a third step under supercritical conditions adapted to separate the solvent from the deasphalted oil.

This process, usually called "Rose Process" has been the object of many patents disclosing different operating conditions, or the use of several solvents as specified, for example, in U.S. Pat. Nos. 3,830,732 and 4,125,459; many papers have also disclosed said technique, one of the most recent being that of S. R. NELSON and R. G. ROODMAN in CHEMICAL ENGINEERING PROGRESS of May 1985, p. 63.

This process suffers from two major disadvantages; firstly, it requires, from an economical point of view, high investment costs since the fractionation of the feedstocks into their three main constituents is performed at high temperature and pressure conditions, secondly, it is not adapted to produce substantially asphalts having a softening temperature higher than about 200° C., the obtained products having such a viscosity that they cannot be pumped, even when heated to temperatures of about 300° C.

SUMMARY OF THE INVENTION

The process according to the present invention is characterized by the following steps of:

(a) suspending solid asphalt, as a powder, into an aqueous phase containing at least one surfactant, (b) treating the asphalt suspension obtained in step (a) by means of a hydrocarbon solvent immiscible with water, (c) separating the resultant hydrocarbon phase from the aqueous suspension wherein is suspended an asphalt of softening point higher than that of the initial asphalt, and (d) fractionating the hydrocarbon phase to separately recover the hydrocarbon solvent and an asphalt having a softening point lower than that of the initial asphalt.

Any aqueous phase wherein the asphalt is insoluble may be convenient. It may consist of water, optionally with dissolved compounds which do not change substantially the insolubility of asphalts therein. The density of the aqueous medium may thus be changed if necessary.

The aqueous suspension obtained in step (c) consists of a suspension of "hard asphalt" particles having a high softening point, easily pumpable and conveyable.

If so desired, the hard asphalt particles may be separated from water by known means, as indicated hereinafter.

The asphalts used according to the invention are solid asphalts which can be obtained as fine particles of a size ranging from 1 to 300 μm; preferably from 3 to 150 μm. Asphalts obtained by deasphalting of heavy oil or of a residue by means of a solvent having 3 to 7 carbon atoms, and whose softening point is higher than about 100° C., are particularly convenient.

The process of the invention may be conducted batchwise or continuously. It may involve the following characteristics:

The asphalt particles are suspended into an aqueous solution containing the surfactant, according to known techniques, in a suitable mixer.

This operation is advantageously conducted within a temperature range from room temperature to the asphalt softening temperature, generally from 15° to 70° C. The ratio by weight of the aqueous solution to the asphalt may vary from 25/75 to 75/25 and preferentially ranges from 30/70 to 60/40. The suspension time is generally from 10 s to 30 mn, depending on the used technique. The resultant suspension is stable and may be stored without settling, thus making possible batchwise operations; in addition, this suspension is easily conveyable or pumpable, its kinematic viscosity being generally from 200 to 5000 $mm^2/s$.

The surfactant used to prepare the suspension may be anionic, cationic, nonionic or zwitterionic.

These surfactants are well known in the art and the invention is not limited to the use of a specific category thereof.

Examples of nonionic surfactants are the products obtained by reacting ethylene oxide, for example, with an alcohol, an alkylphenol, an ester, an amide or an alkylsulfate.

Examples of anionic surfactants are sodium, potassium or ammonium sulfonates such as alkyl-arylsulfonates, alkylsulfates and alkylcarboxylates.

Examples of cationic surfactants are quaternary ammonium salts deriving from tertiary alkylamines, with a long hydrocarbon chain.

Examples of zwitterionic surfactants are alkylcarboxy-betaines and alkylsulfamidobetaines.

These surfactants may be used alone or as mixtures, within their compatibility limit. Thickening or stabilizing agents or any other product for obtaining stable suspensions may be added thereto.

The surfactant content by weight of the aqueous solution is for example from 0.03% to 5%, preferentially from 0.1 to 1%.

The treatment of the asphalt aqueous suspension with a hydrocarbon solvent immiscible with water forms the second step of the progress according to the invention. This step has as an object selective extraction, by means of the solvent, of a portion of the asphalts which consists mainly of "resins" present therein. This operation requires an intimate contact between the solvent and the suspended asphalt. Any apparatus adapted to achieve such a contact can be used, for example reactors provided with such stirring systems as helices or turbines.

The solvents used according to the invention are hydrocarbon solvents immiscible with water, acting as solvents for the "resins" but wherein "asphalts" are insoluble. Preferred solvents are paraffinic, olefinic or cycloparaffinic hydrocarbons having 5 to 8 carbon atoms, used alone or as mixtures. For sake of economy, hydrocarbon cuts such as the so-called "$C_7$" or "light gasoline" cut are advantageously used.

Preferably, the solvents have an average molecular weight at least equal to that of the solvent previously used in the step of producing the asphalt of the process by deasphalting an asphaltic oil. The ratio by weight of the solvent to the suspended asphalt may vary for example from 5/1 to 12/1, preferably from 6/1 to 9/1.

This extraction is conducted at a temperature ranging from room temperature to the asphalt softening temperature. Depending on the type of solvent used and on the softening point of the treated asphalt, it may be conducted under atmospheric or super-atomospheric pressure; it is preferably conducted at a temperature ranging from room temperature to the solvent boiling temperature.

This solvent extraction of the asphalt suspension may be conducted continuously or batchwise. It may be performed either in the same apparatus or in a series of apparatuses in one or several successive operations. For example, a series of mixer-settlers operating countercurrently can be used so as to progressively extract, by means of the extraction solvent, the heavy phase containing the asphalts in suspension. It is also possible to operate in a single apparatus by performing a first extraction with a part of the solvent, waiting until the phases are separated, separating the solvent phase and treating the aqueous phase containing asphalt in suspension with a second part of the solvent, etc . . . The steps of extracting the asphalt suspension by the solvent and of settling into two phases, the organic phase containing the extracted asphalt and the aqueous phase consisting of a suspension of unextracted asphalt particles, may thus be performed in the same apparatus or in different apparatuses.

The extraction time is variable; it depends on the type of feedstock, on the solvent and on the operating conditions; generally it ranges from 15 to 60 minutes.

The step of separation into two phases may be achieved continuously in an apparatus of the settler or centrifuge type; the settling time (or residence time in the settler) is generally from 0.5 to 3 h.

The process provides, by settling, for the separation into two phases:

(1) The upper phase consists of a solution of the extracted asphalts—mainly "resins"—in the extraction solvent; the dry material concentration by weight of said solution depends on the type of asphalt, on the type and amount of solvent as well as on the operating conditions; it is mostly from 3 to 12%. The solvent can be removed from said solution by any convenient means using many devices known in the art as adapted therefor, such for example as flash or thin-layer evaporators. The so-removed solvent may be reused in the extraction step (b) of the process.

The obtained dry residue is formed by the part of initial asphalt which has been extracted by the solvent; its yield and composition may vary very widely. However, it consists mainly of the "resin" fraction of the initial asphalt and also contains a certain proportion of the "oil" fraction.

Its characteristics, as compared with those of the initial asphalt, are:

- a clearly lower softening temperature; this softening temperature decrease may reach, or even exceed 100° C.,
- a reduced metal (Ni and V) and sulfur content,
- an increased H/C atomic ratio,
- a substantial decrease of the $C_7$ asphaltene content, which content is generally below 10%.

Depending on their characteristics, the asphalt fractions, obtained by evaporation of the solvent from the organic phase, may be used in various manners; by way of example, they can be used in the manufacture of bitumen covering for roads or for industrial use; after dilution with a suitable solvent they can be used as fuel oil no. 2, either ordinary or of high viscosity; they can also be used as feedstocks in units of thermal treatment such as visbreaking or hydrovisbreaking, or catalytic hydrotreatments such for example as hydrodesulfurization; they can also be used as starting product for the manufacture of mesophases used for obtaining carbon-carbon composite materials, these examples of use not being limitative.

(2) The lower phase obtained by settling is mainly formed of a suspension of asphalt particles in the aqueous solution containing the surfactant. It generally comprises a small amount of the solvent used for the extraction, which may be evaporated and recycled to the extraction step. The kinematic viscosity of this suspension, at room temperature, is generally from 150 to 4000 $mm^2/s$; this suspension, further exhibiting thixotropic properties, complies with a main characteristic of the invention of being easily pumpable and conveyable. The ratio by weight of the aqueous solution to the asphalt in said suspension is generally from 30/70 to 80/20 and more usually from 35/65 to 65/35.

This asphalt fraction corresponds to the initial fraction of asphalt not extracted by the solvent during the process; hence its "asphaltene" content is increased and its "resin" and "oil" fractions are decreased, the variations of its characteristics, as compared to those of the initial asphalt, being:

- a substantial increase of the softening temperature, measured according to the "ball-ring" method, which may reach or even exceed 100° C.,
- an increase of the sulfur and metal content,
- a high increase of the $C_7$ asphaltene content.

All these characteristics are favorable to the exclusive use as fuel of these "hard asphalts" of very high asphaltene content in certain applications. They can be obtained in solid form from the aqueous suspension, by any convenient separation mans, a particularly advantageous method consisting of breaking the suspension. In solid form, they can be advantageously used as fuel in combustion systems with fluidized beds, in view of their very high softening temperature.

They also can be used as aqueous suspensions similar to the "coal-water" fuel; the content of combustible dry material of the obtained suspension may be easily increased by adding solid particles of various origin such as carbon or biomass, the presence of surfactant in the suspension facilitating this operation.

BRIEF DESCRIPTION OF THE DRAWING

The accompanying drawing is a flow-sheet illustrating an embodiment of the process according to the invention, operated continuously, wherein the asphalt, suspended in an aqueous solution, is subjected to two successive extractions.

According to this flow sheet, the aqueous solution of surfactant is introduced through line (1) into mixer (3) provided with a stirring system (4); the asphalt, as fine particles, is introduced into the mixer (3) through line (2). The suspension of asphalt particles, obtained by stirring, is conveyed through line (5) to the first extractor (6), provided with a stirring system (8). This extractor is fed, through line (7), with solvent originating from settler (19) and which, accordingly, contains the "resin" fraction solubilized during the second extraction step.

The first extraction step is performed by mixing the phases; then, all the phases are discharged from extractor (6) through line (9) towards the first settler (10) wherefrom two phases are separated:

- the upper phase consists essentially of "resins" dissolved in the extraction solvent; it is fed, through line (11), to the solvent evaporator (12). "Resins" are discharged therefrom through line (13) and the extraction solvent, discharged through line (14), is recycled (after passage through a cooler not shown in the figure) to the second extractor (15).
- the lower phase from settler (10), mainly comprising the aqueous suspension of asphalt particles subjected to the first extraction, is discharged through line (17) and conveyed towards the second extractor (15).

The second extraction is achieved by stirring, by means of stirrer (16) in extractor (15) which is supplied, in addition to the pre-extracted asphalt suspension, with all the fresh solvent recycled through line (24). After extraction, all the phases are supplied, through line (18), to the second settler (19), wherefrom, after settling, two phases are withdrawn:

the upper phase consists of a solution of low "resin" concentration in the extraction solvent; it is recycled through line (7) to the first extractor (6)

the lower phase essentially comprises an aqueous suspension of asphalt particles previously subjected to two extractions, as well as a small amount of extraction solvent.

It is conveyed from settler (19) through line (20) towards the solvent evaporation system (21), wherefrom the "hard asphalts" or "pitches" in aqueous suspension are withdrawn, through line (22). From the top of the evaporation system (21) a small fraction of solvent is recovered through line (23) and joined to the greater part of the solvent, conveyed through line (14), all the recovered solvent being recycled through line (24) to the second extractor (15).

Additional solvent may be introduced through line (25) in order to compensate for small solvent losses.

Instead of the above-described mixer-settlers, a multistage extractor, for example of the rotary disc type, can be used.

EXAMPLES

The following examples are given to illustrate the invention and must not be considered as limiting the scope thereof. They describe a batchwise mode of asphalt fractionation.

Example 1

The asphalt, which forms the feedstock to fractionate, originates from a unit for pentane deasphalting of a Safaniya crude oil vacuum residue. This asphalt, whose main characteristics are given in table I, has been crushed to fine particles by means of a hammer crusher. The obtained particles have a size ranging from 3 to 130 μm, and 50% by weight of these particles are of a diameter from 20 to 60 μm, A 200 l reactor provided with helix stirring means, is fed successively with:

25 kg of an aqueous solution containing 0.5% by weight (125 g) of tall-oil (anionic surfactant of the trade, obtained in the manufacture of paper pulp) and 0.125% by weight of sodium hydroxide (31.25 g), and with 25 kg of asphalt particles.

After 30 min of stirring at 60° C., an homogeneous suspension of asphalt particles is obtained whose kinematic viscosity is 300 $mm^2/s$.(cSt)

130 l of heptane are introduced into the reactor and vigorously stirred for 30 minutes at a temperature of 60° C. After maintaining at rest for 3 h, the formed upper phase, amounting to 120 liters, is withdrawn.

A second extraction is then performed by adding 120 l of heptane to the asphalt suspension remaining in the reactor, the operating conditions being the same as for the first extraction.

After settling, the asphalt aqueous suspension is withdrawn from the bottom of the reactor, separately from the supernatant heptane which then joins the hydrocarbon phase obtained during the first extraction step.

The hydrocarbon phase (240 l) is brought to 180° C. in a thin-layer evaporator; 225 l of heptane and 11 kg of "resins" are obtained, whose main characteristics are given in table I.

From the lower phase, 20 l of heptane are withdrawn by distillation. The remaining aqueous suspension (39 kg) has a kinematic viscosity of 220 $mm^2/s$ (cSt). After filtration and drying at 150° C., 14 kg of "hard asphalt" are obtained, whose characteristics are given in table I.

EXAMPLES 2 TO 4

Example 1 is repeated, but with other surfactants, in the same proportion by weight as in example 1, in example 2, a cationic surfactant of the trade, of the fatty aliphatic monoamine type, is used in acid medium;

in example 3, an anionic surfactant of the trade, from the class of the alkyl aryl sulfonates, is used, in example 4, the surfactant, of nonionic type, is a polyoxyethylated alkyl phenol.

Substantially, the same results are obtained. However anionic surfactants are preferred in view of the greater easiness to break the aqueous suspension by addition of acid.

TABLE I

| | INITIAL ASPHALT | "RESIN" FRACTION | "HARD ASPHALT" FRACTION |
|---|---|---|---|
| Weight in kg | 25 | 11 | 14 |
| Yield % | — | 44 | 56 |
| Softening temperature, °C. | 162 | 96 | >300 |
| S % | 7.0 | 5.5 | 8.2 |
| Ni ppm | 130 | 66 | 180 |
| V ppm | 450 | 180 | 670 |
| H/C atomic ratio | 1.22 | 1.43 | 1.05 |
| $C_7$ asphaltenes % | 45 | <0.5 | 82.6 |
| $C_5$ asphaltenes % | 70 | 44.5 | 91.4 |

What is claimed as the invention is:

1. A process for fractionating asphaltene- and resin-containing solid asphalt, comprising the following steps of:

(a) suspending asphaltene- and resin-containing solid asphalt particles into an aqueous phase containing at least one surfactant, (b) extracting the solid asphalt suspension obtained in step (a) with a selective hydrocarbon solvent for resins, so as to yield a resin-containing hydrocarbon phase and an aqueous suspension of asphalt enriched in asphaltenes and having an increased softening point with respect to the asphalt of step (a), (c) separating the resultant hydrocarbon phase from the aqueous suspension and (d) fractionating the resin-containing hydrocarbon phase of step (c) to recover the solvent and resin separately, whereby said resin has a softening point lower than that of the initial asphalt.

2. A process according to claim 1, wherein the solid asphalt particles have a size from 1 to 300 microns.

3. A process according to claim 1, wherein the ratio by weight of the aqueous phase to the asphalt, in step (a), is from 25/75 to 75/25.

4. A process according to claim 1, wherein the surfactant content by weight of the aqueous phase in step (a) is from 0.03 to 5%.

5. A process according to claim 1, wherein the resin-containing solid asphalt results from deasphalting an asphaltic oil with a hydrocarbon solvent and the hydrocarbon solvent of step (b) has an average molecular weight at least equal to the average molecular weight of the hydrocarbon solvent used in said deasphalting of the asphaltic oil.

6. A process according to claim 1, wherein the ratio by weight of the solvent to the asphalt in step (b) is from 5/1 to 12/1.

7. A process according to claim 1, wherein the asphalt aqueous suspension obtained in step (c) is further extracted in a step (e) with a selective hydrocarbon solvent, for resins and a hydrocarbon phase is separated from a resultant aqueous suspension, said hydrocarbon phase, obtained in step (e), is fed back to step (b) to form at least a part of the hydrocarbon solvent.

8. A process according to claim 1, wherein the hydrocarbon solvent of step (b) is selected from paraffinic, olefinic and cycloparaffinic hydrocarbons having from 5 to 8 carbon atoms.

9. A process according to claim 1, wherein in step (b) the ratio by weight of the solvent to the solid asphalt suspension obtained in step (a) is from 6/1 to 9/1.

10. A process according to claim 1, wherein the extraction temperature in step (b) is about room temperature to the softening temperature of the solid asphalt.

11. A process according to claim 1, wherein the extraction temperature in step (b) is about room temperature to the solvent boiling temperature.

12. A process according to claim 1, wherein the particle size of the solid asphalt particles in step (a) is 3–130 μm.

13. A process according to claim 12, wherein 50% of the particles have a size of 20–60 μm.

14. A process according to claim 1, wherein the surfactant is an anionic surfactant.

15. A process according to claim 1, wherein the softening point of the solid asphalt particles in step (a) is higher than about 100° C.

16. A process for fractionating resin-containing solid asphalt, comprising the following steps of:

(a) comminuting said resin-containing solid asphalt to particles of 1–300 μm size and suspending resultant comminuted solid asphalt particles into an aqueous phase containing at least one surfactant, (b) extracting the suspension of solid asphalt particles from step (a) with a $C_5$–$C_8$ hydrocarbon solvent selective for resins, so as to form an aqueous suspension of asphalt, said asphalt having an increased softening point with respect to the comminuted asphalt, and a resin solution in the hydrocarbon solvent, (c) separating the resin solution from the aqueous suspension of asphalt, (d) fractionating the resin solution of step (c) to separately recover hydrocarbon solvent and resin, and (e) fractionating the aqueous suspension of step (c) to recover said asphalt of increased softening point.

* * * * *